United States Patent [19]

Bogensberger

[11] 4,114,847

[45] Sep. 19, 1978

[54] FEEDING BOTTLE HOLDER

[76] Inventor: Joseph Bogensberger, Box 208, Sundridge, Ontario, Canada, POA 1Zo

[21] Appl. No.: 787,127

[22] Filed: Apr. 13, 1977

Related U.S. Application Data

[63] Continuation of Ser. No. 651,314, Jan. 22, 1976, abandoned.

[51] Int. Cl.[2] ..... A47D 15/00

[52] U.S. Cl. ..... 248/104

[58] Field of Search ..... 248/102, 103, 104, 105, 248/106, 160

[56] References Cited

U.S. PATENT DOCUMENTS

| | | | |
|---|---|---|---|
| 1,315,621 | 9/1919 | Barlow | 248/104 |
| 1,987,132 | 1/1935 | Shine | 248/104 |
| 2,909,345 | 10/1959 | Matsuoka | 248/106 |
| 3,161,392 | 12/1964 | Kopec et al. | 248/104 |
| 3,180,600 | 4/1965 | Kopec | 248/104 |
| 3,519,231 | 7/1970 | Miller | 248/106 |

FOREIGN PATENT DOCUMENTS

| | | | |
|---|---|---|---|
| 187,972 | 3/1905 | Fed. Rep. of Germany | 248/104 |

*Primary Examiner*—Robert A. Hafer
*Attorney, Agent, or Firm*—Fred Philpitt

[57] ABSTRACT

An improved feeding bottle holder is provided. It includes a bore clamp; a fixed length, self-sustaining, position-sustaining, but flexible, arm rigidly secured at one end to the bore clamp; and a bottle holder rigidly secured to the other end of the arm. By this construction, the bottle can follow minor movements of the mouth of a baby being fed without the baby losing feeding contact. If the baby should lose feeding contact, the bottle holder applies gentle pressure to the cheek of the baby, thereby, inducing refeeding contact.

5 Claims, 1 Drawing Figure

FEEDING BOTTLE HOLDER

Figure 1:
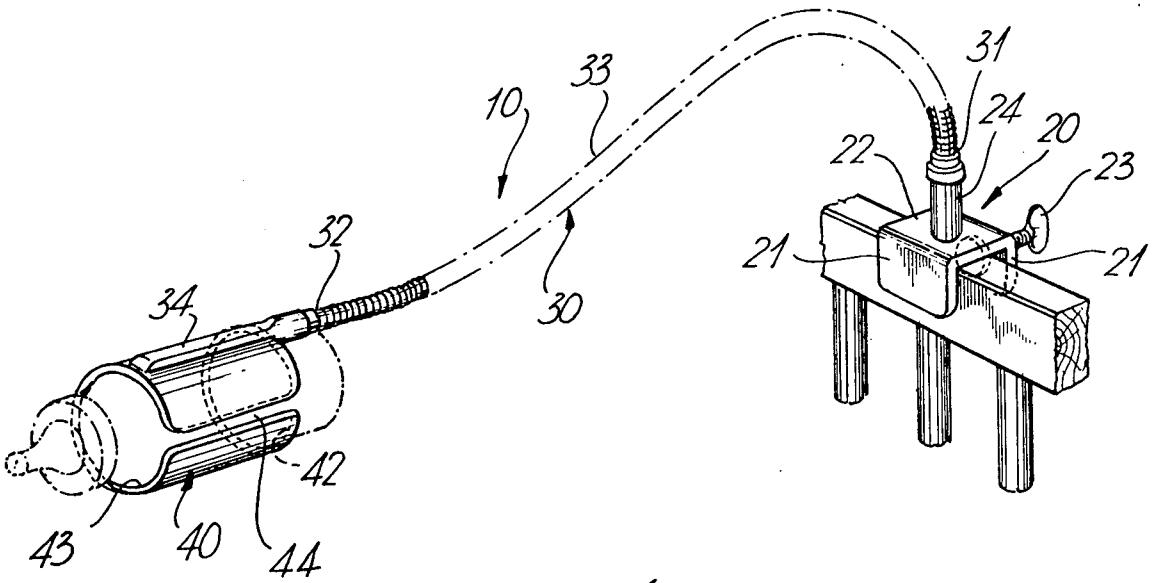

This is continuation of application Ser. No. 651,314, filed Jan. 22, 1976, now abandoned.

This invention relates to a feeding bottle holder.

In many instances, babies are fed by means of a bottle held by an adult or older child. The need exists, however, for a mechanical means to hold such feeding bottle in order to enable the adult or older child to perform other duties.

One solution to this problem has been provided in Canadian Pat. No. 435,315. That patent is directed to a feeding bottle holder including a base clamp and a frame slidably and rotatable in the clamp. A telescopic arm is carried by the frame, and a bottle holder is pivotally attached to the extremity of the telescopic arms. While this holder does provide a mechanical bottle holder, the bottle is not always held precisely where the mouth of the baby is disposed, particularly when the baby moves his head. Because of the particular mechanical linkages on this bottle holder, the bottle holder does not follow accurately the path of movement of the mouth of the baby.

Thus, it is an object of one aspect of this invention to provide an improved feeding bottle holder.

It is an object of another aspect of this invention to provide such an improved feeding bottle holder which can accurately follow the movement of the mouuth of a baby being fed.

It is an object of yet another aspect of this invention to provide such an improved feeding bottle holder which can induce a baby to resume feeding should the baby move in such a way that the bottle holder does not accurately follow the baby's movement.

By one aspect of this invention, a feeding bottle holder is provided comprising a base clamp; a fixed length, self-sustaining but flexible arm rigidly secured at one end to the base clamp; and a bottle holder rigidly secured to the other end of the arm.

The base clamp may be any conventional type of clamp. One type is a C-type frame with a thumb-screw threaded therein. It may be made of any suitable material, for example, steel, aluminum, plastics (polyvinyl chloride, polyethylene, etc.)

The arm can be made of a solid rigid but flexible plastic rod (i.e., of polyvinyl chloride, polyethylene, polyprepylene, etc.) or of a helically wound hollow tube formed of metal, plastics, fiberglass, etc.

The bottle holder generally is formed of a material which can flex and which has an "at-rest" spacing between two parts less than the diameter of the bottle being held, but which can be resiliently spread apart to grip the bottle. It may be made of a resilient sheet of metal or a cast or extruded plastic material article of a suitable shape.

In the accompanying drawing, the single FIGURE is a perspective view of the feeding bottle holder of one aspect of this invention.

The feeding bottle holder 10 as shown includes three main elements, namely the base clamp 20, the arm 30 and the bottle holder 40. The base clamp 20 is of generally "C"-shape and includes a pair of spaced apart arms 21 connected by a bridge 22. Threaded through one of the arms 21 is a thumb-screw 23. The arms 21 are spaced apart by a distance greater than the width of the base to which the bottle holder 10 is to be attached. The clamp 20 is mounted on the base, and is secured thereto by the thumb screw 23. The bridge 22 is provided with an upstanding post 24 to enable rigid attachment of the arm 30.

Arm 30 includes a distal end 31 and a proximal end 32, which are generally relatively rigid, with a main arm portion 33 disposed therebetween. Distal end 31 is adapted to be rigidly secured to post 24 of base clamp 20. Proximal end 32 is adapted to be rigidly secured to bottle holder 40. Main arm portion 33 is not only form sustaining but also is position sustaining. However, since main arm portion 33 it may flex the proximal end 32 the arm 30 can move in virtually any direction to trace a substantially spatially unhindered path. Moreover, main arm portion 33 is not so flexible with too great an elastic memory that main arm poriton 33 would lead proximal end 32; it is proximal end 32 which operates and controls the position of main arm portion 33. The proximal end 32 is also provided with an integral securement bar 34.

Bottle holder 40 is of any type which can grip and securely hold a bottle. As shown, however, it is a generally open cyclindrical member 41 having a pair of open ends 42, 43, and a longitudinal slit 44 in the circumferential wall. The slit 44 may be provided with outturned lips (not shown). The circumferential wall of cylindrical member 41 is rigidly attached to securement bar 34.

In use, as the baby being fed moves his mouth, the proximal end 32 of arm 30 is free to move, and enables the orientation of the arm 30 while retaining the bottle is the same general spatial area. If the baby moves so that he temporarily looses the bottle, the bottle holder gently applies pressure to the cheek of the baby, inducing him to recommence feeding.

I claim:

1. A feeding bottle holder comprising (a) a base clamp, (b) a fixed length, self-sustaining, position sustaining, flexible arm rigidly secured at its distal end thereof to said clamp; and (c) a bottle gripper for grippingly engaging a bottle, said bottle gripper comprising an open cylindrical member having a longitudinal slit therein, said cylindrical member being of substantially the same length as the bottle to be gripped, whereby the cylinder may open to receive and grippingly engage a bottle and provide a protective enclosure for said bottle, said bottle gripper being rigidly secured to the proximal end of said arm, by means including an integral longitudinal securement spline extending along substantially the entire longitudinal length of said open cylindrical member adjacent said longitudinal slit, said spline terminating in an integral longitudinally extending cylindrical coupling overhanging the adjacent rim of the open cylindrical member and rigidly secured to said flexible arm, with the longitudinal axes of said spline, said cylindrical coupling and the coupled end of said flexible arm being coextensive, said longitudinal securement spline and said flexible arm combining to provide positive retention action which minimizes the movement of the bottle caused by motion of the liquid contained therein.

2. The feeding bottle holder of claim 1 wherein the base clamp is a "C"-clamp.

3. The feeding bottle holder of claim 1 wherein the arm is formed of a solid rod of synthetic plastic material have high flexural characteristics but low elastic memory.

4. The feeding bottle holder of claim 1 wherein the arm is formed of a helically wound hollow tube.

5. The feeding bottle holder of claim 1 wherein the bottle holder is a open cylindrical member having a longitudinal slit therein, whereby the cylinder may open to receive and grippingly engage a bottle.

* * * * *